United States Patent [19]

Miller

[11] 4,368,566

[45] Jan. 18, 1983

[54] UPHOLSTERY MACHINE

[76] Inventor: Richard H. Miller, 3067 Seaview Ave., Ventura, Calif. 93001

[21] Appl. No.: 176,460

[22] Filed: Aug. 8, 1980

[51] Int. Cl.[3] ..... B68G 7/08

[52] U.S. Cl. ..... 29/91.4; 29/91.2; 112/108

[58] Field of Search ..... 29/91.4, 91.2, 91.3; 227/31, 55; 112/106, 107, 108, 109; 221/259, 278, 268, 270, 272; 198/836, 688, 747

[56] References Cited

U.S. PATENT DOCUMENTS

| | | | |
|---|---|---|---|
| 373,330 | 11/1887 | Bennett | 112/108 X |
| 537,688 | 4/1895 | Kistner | 29/91.3 |
| 652,220 | 6/1900 | Phelps | 112/108 |
| 661,302 | 11/1900 | Bernhardt et al. | 29/91.4 |
| 776,055 | 11/1904 | Grosjean et al. | 29/91.3 |
| 916,120 | 3/1909 | Dickson | 29/91.4 |
| 1,083,907 | 1/1914 | Anderson | 112/108 |
| 1,220,237 | 3/1917 | Kenyon | 29/91.3 |
| 3,253,692 | 5/1966 | Ota | 198/688 |
| 4,185,367 | 1/1980 | Puchy | 29/91.4 X |

FOREIGN PATENT DOCUMENTS

| | | | |
|---|---|---|---|
| 55-123808 | 9/1980 | Japan | 198/688 |

*Primary Examiner*—Horace M. Culver
*Attorney, Agent, or Firm*—Jack C. Munro

[57] ABSTRACT

An upholstery machine for the tufting of buttons within cushions wherein a needle is caused to penetrate the cushion and pick up a string loop which is attached to a lower button. The needle is then withdrawn from the cushion and the needle removed from the string loop at which time an upper button is attached to the string loop thereby resulting in a completed button assembly being connected to the cushion.

36 Claims, 28 Drawing Figures

Fig. 1.
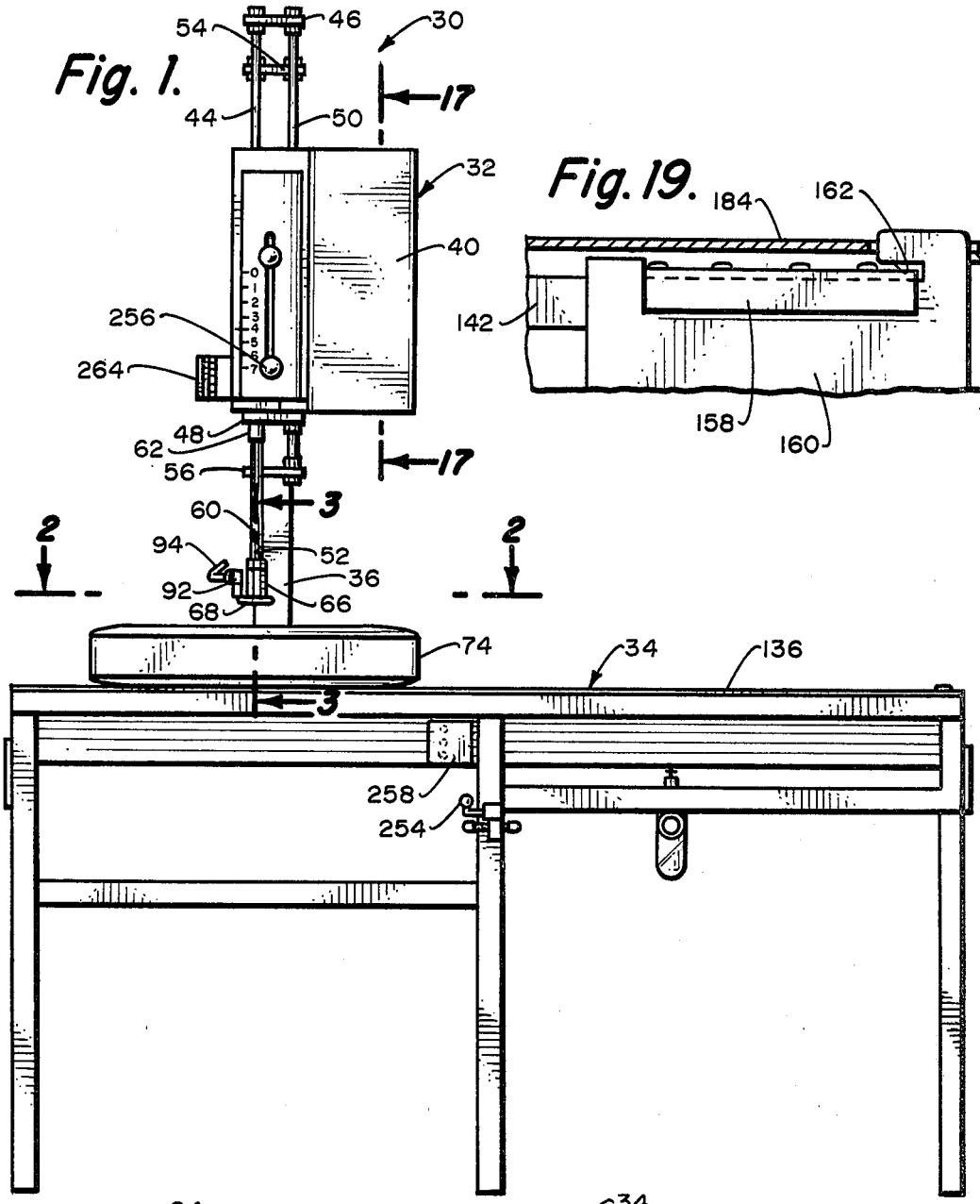
Fig. 19.
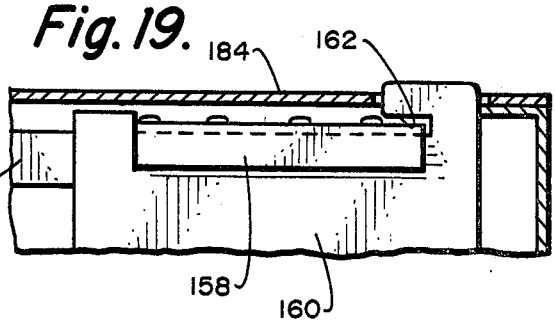
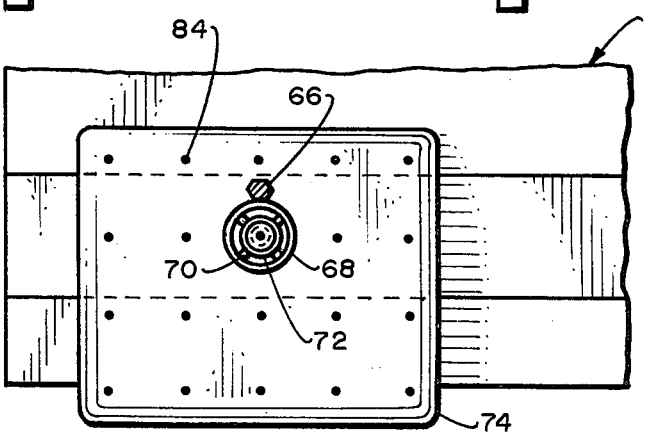
Fig. 2.

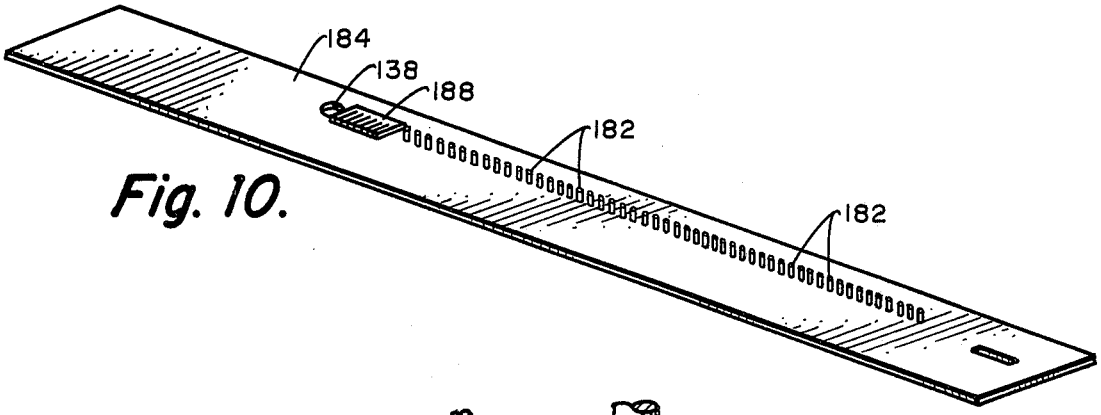
Fig. 10.
Fig. 3.
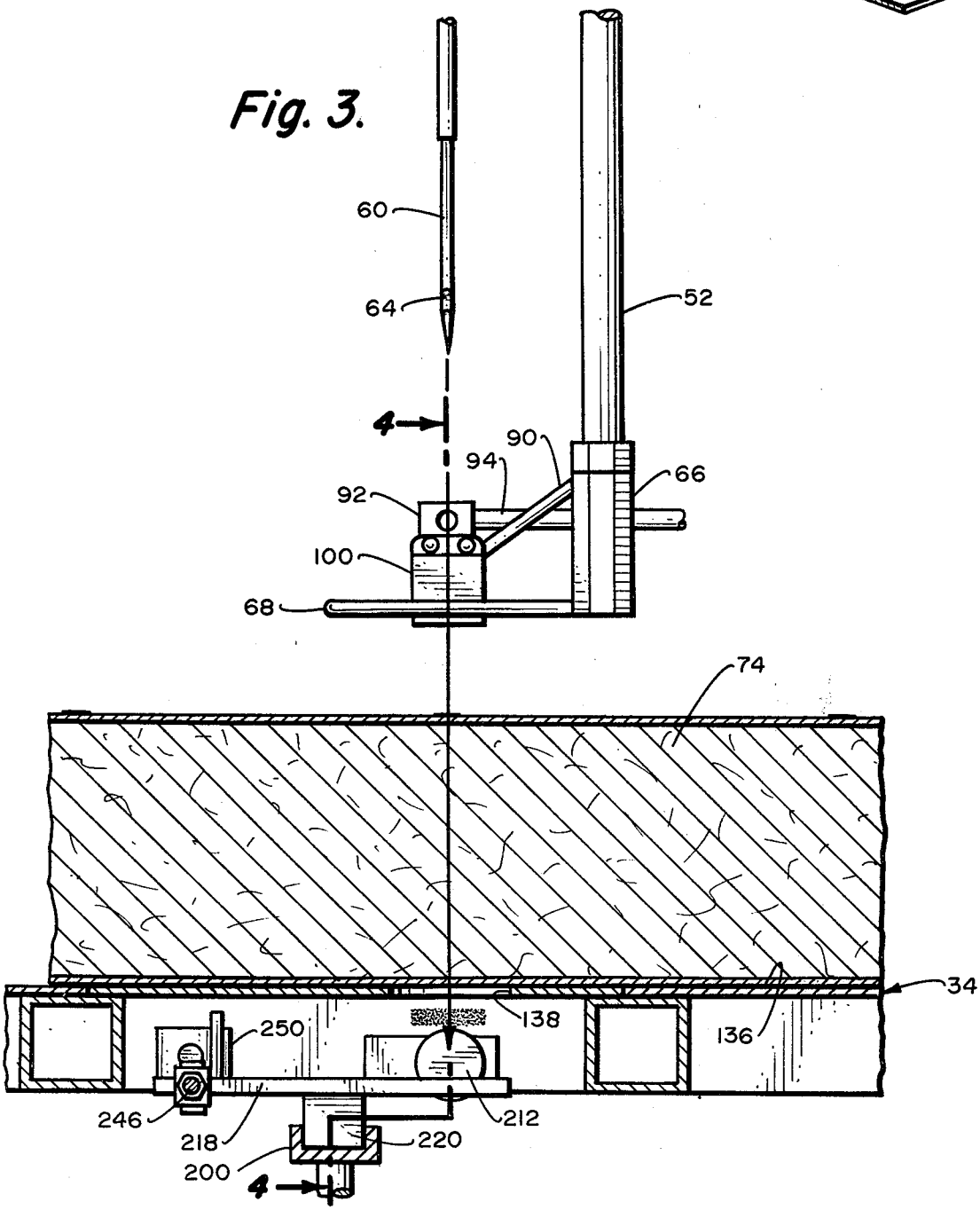

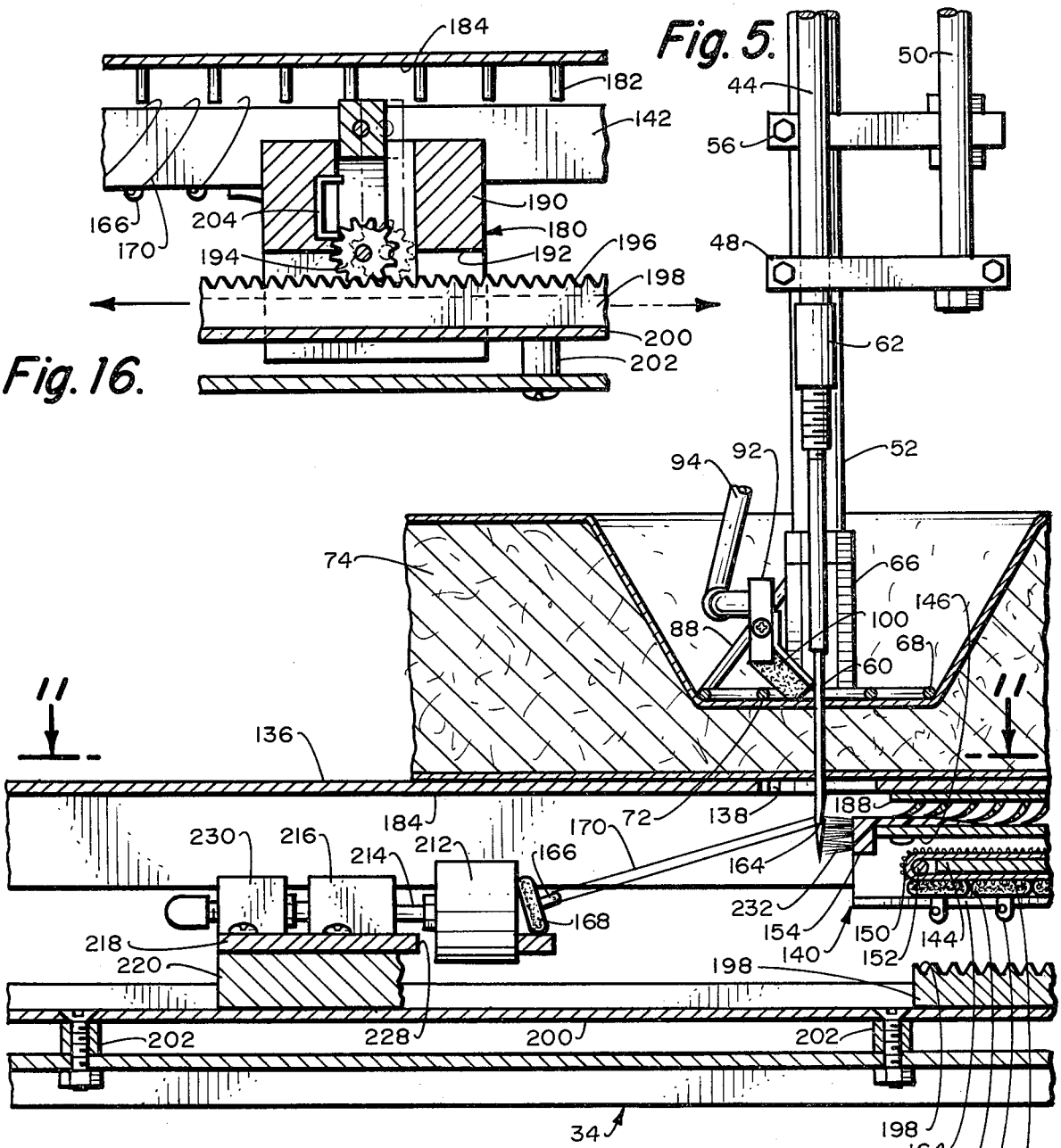
Fig. 5.
Fig. 16.
184
182
142
190
180
166
170
204
194
192
196
198
200
202
50
44
56
48
62
52
94
92
74
66
146
100
88
68
60
11
11
136
184
170
72
138
188
230
216
214
212
166
164
232
154
150
144
140
152
168
218
220
198
202
228
200
202
34
198
164
148
166
168
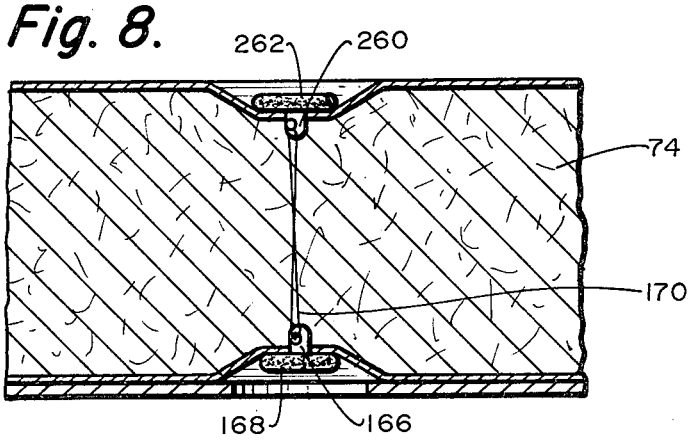
Fig. 8.
262
260
74
170
168
166

UPHOLSTERY MACHINE

BACKGROUND OF THE INVENTION

The field of this invention relates to an upholstery machine, and more particularly to an upholstery machine which is to be usable for the tufting of buttons within cushions.

The typical cushion comprises a pad which is enclosed by a fabric, vinyl or leather. In order to give the cushion an attractive exterior appearance, the cushion may have a plurality of spaced-apart buttons tufted into the exterior surface of the cushion.

The normal procedure prior to this invention for the tufting of buttons has been strictly manual. The button assembly takes the form of a lower button and an upper button which are usually identical. The lower button has attached thereto a string loop. The length of the string loop is selected to be a certain length less than the thickness of the cushion. The string loop is connected to a slot in an elongated needle. The operator then passes the needle through the cushion at the desired location. The operator pulls the string loop tight until the bottom button is pushed tightly against the bottom surface of the cushion. The operator continues to hold the string loop tight and then compresses the top surface of the cushion about the area of the string loop. The operator takes a top button and attaches it to the string loop and then manually releases the needle. The operator then releases the cushion which permits the cushion to expand back to its normal state which results in the top button being pushed tightly against the top surface of the cushion.

It is not at all unusual for a typical cushion to have as many as ten, fifteen or twenty button assemblies. This manual procedure for the attaching of buttons is extremely timed consuming and as a result, it is labor expensive. There is a definite need for a machine which would at least semi-automate the tufting of buttons within cushions which would substantially decrease the time required for the tufting of buttons within cushions.

SUMMARY OF THE INVENTION

The upholstery machine of the present invention is for tufting of buttons within cushions. A cushion is to be located on an operating table. A ring is moved downwardly onto the cushion compressing a portion of the cushion. A needle is then moved through the cushion and protrudes from the bottom side of the cushion. A button from a button dispensing device mounted within the operating table is dispensed and is held by a magnet assembly directly adjacent the needle. This button includes a loop of string and the string is caused to engage with a slot within a needle. The needle is then retracted until this button is tight against the bottom surface of the cushion. The loop of string is then caused to be removed from the needle and a second, or top button, is manually attached to the loop of string. The compressing ring is then retracted resulting in a button assembly being installed within the cushion.

The primary objective of this invention is to construct an upholstery machine which installs buttons within cushions much faster than such installation can be accomplished manually.

BRIEF DESCRIPTION OF THE DRAWINGS

FIG. 1 is a front view of the upholstery machine of this invention with a cushion located on the operating table and the machine in the initial position prior to installation of a button assembly within the cushion;

FIG. 2 is a top plan view of the cushion taken along line 2—2 of FIG. 1;

FIG. 3 is a right side view of a portion of the machine of this invention taken along line 3—3 of FIG. 1;

FIG. 5 is a view similar to FIG. 4, but with the needle in the lowered position having penetrated the cushion and the single dispensed button having been moved so that the loop of string attached to the button has become engaged with the slot formed in the needle;

FIG. 8 is a cross-sectional view through a cushion showing the completely installed button assembly;

FIG. 10 is an up-side-down isometric view of the cover which is formed as part of the top surface of the operating table within the upholstery machine of this invention which is to be used to enclose the structure shown within FIG. 9;

FIG. 16 is a cross-sectional view taken along line 16—16 of FIG. 14;

FIG. 19 is a cross-sectional view showing in detail the device for accurately positioning and locking in the button dispensing mechanism of this invention taken along line 19—19 of FIG. 9;

DETAILED DESCRIPTION OF THE SHOWN EMBODIMENT

Figure 4:
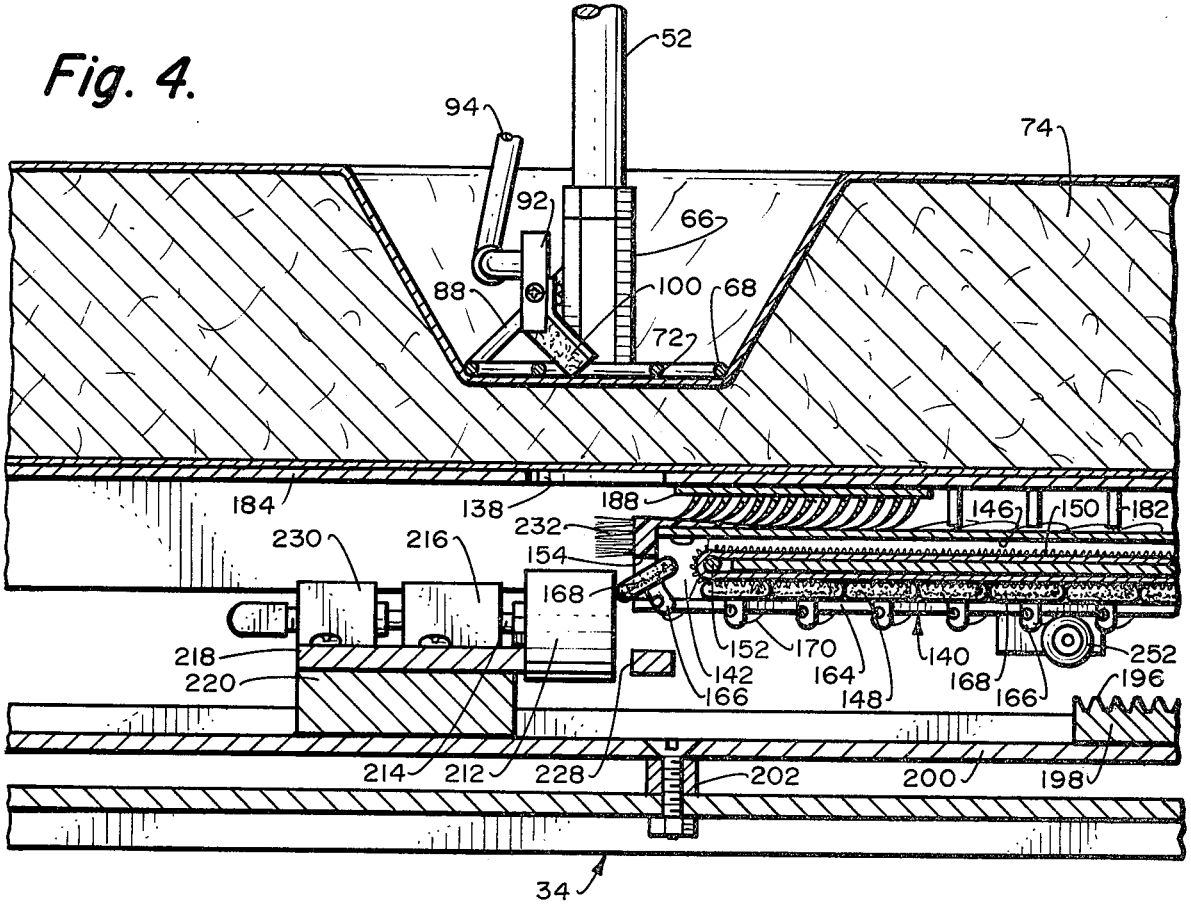
FIG. 4 is a view taken along line 4—4 of FIG. 3 but showing the compression ring in the lowered position compressing a portion of the cushion and the button dispensing mechanism having initiated the dispensing of a single button.

Referring particularly to the drawings, there is shown an upholstery machine 30 of this invention which is generally constructed of an upright stanchion 32 and a table section 34. The upright stanchion section 32 is fixedly attached to the table section 34 by tube 36.

The upright stanchion section 32 includes a housing 40. The housing 40 is attached to the tube 36. Within the housing 40 there is fixedly mounted a first actuating cylinder 42. This cylinder 42, as well as all other cylinders described in conjunction with this invention, are to be operated pneumatically. However, it is to be considered to be within the scope of this invention that the cylinders could be operated with other fluids, such as a liquid.

Cylinder 42 has a piston rod 44 extending therefrom. The upper end of the rod 44 is attached to a first plate 46. The lower end of the rod 44 is attached to a second plate 48. Mounted in a parallel relationship with the piston rod 44 and also attached between the plates 46 and 48 is a second rod 50. The second rod 50 is slidably mounted in close fitting openings formed within the housing 40. The purpose of the second rod 50 is to prevent rotation of the rod 44.

A second cylinder (not shown) is also mounted within the housing 40 and would be located directly behind the cylinder 42. The second cylinder has a piston rod 52 which is fixedly secured between an upper plate 54 and a lower plate 56. In order to prevent rotation of the piston rod 52, a second rod 58 is attached between the plates 54 and 56 in a manner similar to previously described second rod 50. This rod 58 is also mounted for sliding movement within the housing 40.

A needle 60 is screw threadingly mounted within an arbor 62. The arbor 62 is fixedly secured to the rod 44 which extends through plate 48. The needle 60 includes an engagement means in the form of slot 64 adjacent its outermost tip. It is to be understood that actuating of cylinder 42 causes the needle 60 to move between a lower position and an upper position which will be explained in more detail further on in the specification.

Figure 17:
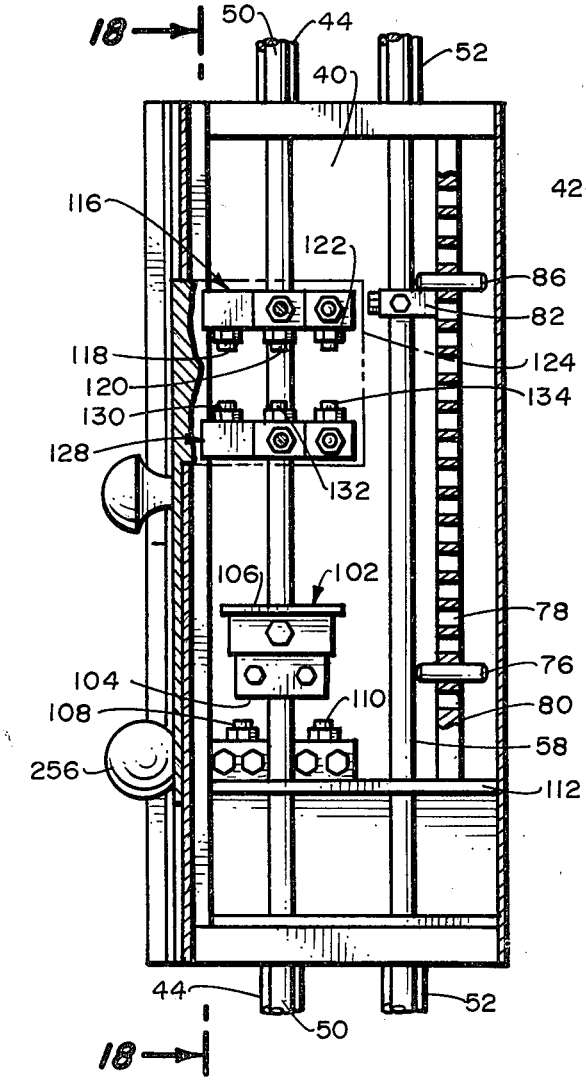
FIG. 17 is a cross-sectional view through the upright stanchion section of the upholstery machine of this invention taken along line 17—17 of FIG. 1.

Piston rod 52 is attached to a socket 66. The socket 66 in turn is fixedly attached to an outer ring 68. Ring 68 is secured by braces 70 (four in number) to an inner ring 72. The inner ring 72 is concentrically located within the outer ring 68. This ring assembly composed of rings 72 and 68 are to function to compress a portion of the cushion 74. This ring assembly is to be movable by actuating of a cylinder (not shown) from an upward position shown within FIG. 3 to a downward position shown within FIGS. 4–7. The amount of compression of the cushion 74 is shown to be about a fourth of its normal thickness. However, it is to be understood that this amount of compression can be adjusted through the use of stop pin 76 shown within FIG. 17 of the drawings.

Stop pin 76 is to be connectable with any one of a series of holes 78 formed with a plate 80. This plate 80 is fixedly mounted within the housing 40 directly adjacent second rod 58. It is to be restated that second rod 58 is attached to the piston rod 52 and is movable in conjunction therewith.

Fixedly attached to the second rod 58 in a particularly desired position is a stop member 82. When the actuator for the piston rod 52 is actuated to move the piston rod 52 in a downward position, the stop member 82, upon contacting of stop pin 76, will prevent further downward movement of the compression ring assembly formed by rings 68 and 72. Pin 76 is to be located in a desired hole 78 prior to operating of the upholstery machine 30 of this invention. In other words, as for example, if the cushion 74 is four inches in thickness and it is desired to compress the cushion 74 down to an one inch thickness, then the stop pin 76 will be located within the opening 78 which will achieve this amount of compression. Normally, there will be appropriate indicia (not shown) on the plate 80 to instruct the user to the appropriate amount of compression that would be desired.

Also, the upward limit of the ring assembly formed by rings 68 and 82 is to also be preselected. Normally, it would be desired to have the ring assembly located a short distance above the top surface of the cushion 74. The reason for this is that the center of the ring 72 is to be used as a locating guide to locate exactly at what point on the cushion 74 the button assembly (to be described) is to be installed. The cushion 74 is to have been previously marked by dots 84 to indicate at what point within the cushion 74 is to be installed a button assembly. With the compression ring assembly located a slight distance above the top of the cushion 74, the operator will manually move the cushion 74 until a particular desired dot is centrally disposed with respect to the ring 72. This tells the operator that the cushion 74 is in the proper position. However, cushion 74 may be up to ten inches thick, or may be only two inches thick. Therefore, the locating of the ring assembly 68 and 72 in a closely spaced relationship above the top surface of the cushion 74 is to be initially set through the use of stop pin 86 within one of the series of holes 78. With the compression ring assembly in the uppermost position, the stop member 82 will contact the stop pin 86 as shown within FIG. 17 of the drawings. Again, appropriate indicia (not shown) will be formed on the plate 80 to indicate the uppermost position of the compression ring assembly.

Figure 18:
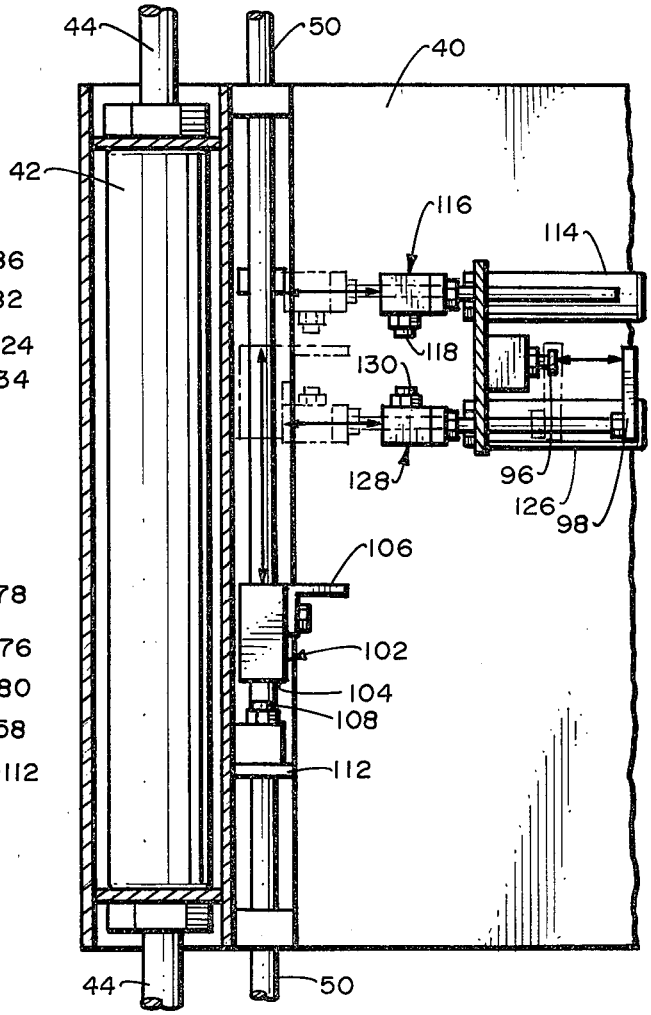
FIG. 18 is a cross-sectional view taken through line 18—18 of FIG. 17.

Also mounted on the compression ring assembly 68 and 72 by means of brace rods 88 and 90 is an airstream nozzle 92. It is to be understood that the brace rods 88 and 90 are fixedly secured between the socket 66, the ring 68 and the housing of the nozzle 92. The nozzle 92 is to be supplied pressurized air through a conduit 94. The conduit 94 is to receive air from a source (not shown) upon actuation of a valve 96 (see FIG. 18). This valve 96 is actuated upon coming into contact with cam block 98. The sequence of events leading to the operation of the valve 96 will be explained further on in the specification.

It is also to be noted that attached to the housing of the nozzle 92 is a keeper 100. Basically, the keeper 100 comprises a pad of flexible material, such as leather, rubber, or plastic. This keeper 100 merely extends outwardly and downwardly with respect to the housing of the nozzle 92. Basically, the keeper 100 constitutes a flap which is to be contactable by the needle 60 in moving downward through the cushion 74. The exact function of the keeper 100 will be explained further on in the specification.

The needle 60, as previously mentioned, is to be movable to a lower position from an upper position. Actually, within the upper position there is an uppermost position, an intermediate upper position and a lower upper position. The movement of the needle 60 to these various positions is accomplished by means of the following structure: It is to be restated that needle 60 is attached to piston rod 44 which in turn is moved between the aforementioned positions by the actuating cylinder 42. Also, as previously mentioned, the second rod 50 moves in conjunction with the piston rod 44. Attached onto the second rod 50 is a cam block 102. Cam block 102 has a lower cam surface 104 and an upper cam surface 106. The cam surface 104, with the needle 60 at the lowest point of travel, is to contact bleeder valves 108 and 110. These valves 108 and 110 are mounted on a plate 112 which in turn is fixedly mounted on the housing 40. The function of the valve 108 will be explained further on in the specification. However, valve 110 causes actuation of actuator 114 (FIG. 18) which causes bleeder valve assembly 116 to move from the solid line position to the dotted line position (directly adjacent rod 50) as is shown within FIG. 18.

The bleeder valve assembly 116 includes three in number of bleeder valves 118, 120, 122. The actuator 114 is mounted on a plate 124, which in turn is attached to the housing 40. Upon the cam surface 106 being moved upwardly, it will now contact the bleeder valves 118, 120, and 122 which have been extended. Bleeder valve 122 causes actuation of actuator 126. Actuator 126 is also mounted on plate 124 and causes a second bleeder valve assembly 128 to also extend adjacent the rod 50.

Bleeder valve assembly 128 also includes three in number of bleeder valves 130, 132 and 134. At this particular intance, the bleeder valves 130, 132 and 134 are in essence in a mirror relationship with respect to the valves 118, 120 and 122. Mirror of the needle 60 in the downward direction will then cause the lower portion of the cam surface 106 to contact the bleeder valves 130, 132 and 134. The actuator of bleeder valve 134 causes actuator 114 to retract, which causes the bleeder valve assembly 116 to move again to the solid line position as shown within FIG. 18. This means that upon the rod 50 moving in an upward position, it will then pass by bleeder valve assembly 116 which will result in cam surface 106 being located directly adjacent the top of the housing 40. Actually, the actuator 42 will be bottomed out in this particular direction so cam surface 106 does not contact the housing 40. A complete description of the actuation of all of the aforementioned bleeder valves will follow in a discussion of the operation of the upholstery machine 30 of this invention.

The table assembly 34 has a planar operating surface 136 upon which is to rest the cushion 74. Within the operating surface 136 there is formed an opening 138. Through the opening 138 the needle 60 is to be conducted, as is clearly shown within FIG. 5.

Mounted within the table section 34 is a button dispensing mechanism 140. The button dispensing mechanism 140 takes the form of an elongated metallic housing 142. Located internally of the housing 142 is an elongated dividing web 144. The web 144 internally divides the housing 142 into an upper compartment 146 and a lower compartment 148. Positioned against the web 144 and located within both compartments 146 and 148 is an endless belt strip 150 of frictionally grabbing material. The belt 150 is mounted on rotatable rollers, such as roller 152 located directly adjacent the open discharge end 154 of the housing 142. It is to be understood that a similar roller will be mounted within the housing 142 adjacent the innermost end of the elongated housing 142 so that the strip 150 is capable of moving in essence like a conveyor belt. The actual material of construction of the strip 150 can take numerous forms. A desirable material of construction will be material which is constructed of a mass of tiny eyelets which is frequently sold under the trade name of "VELCRO".

Figure 20:
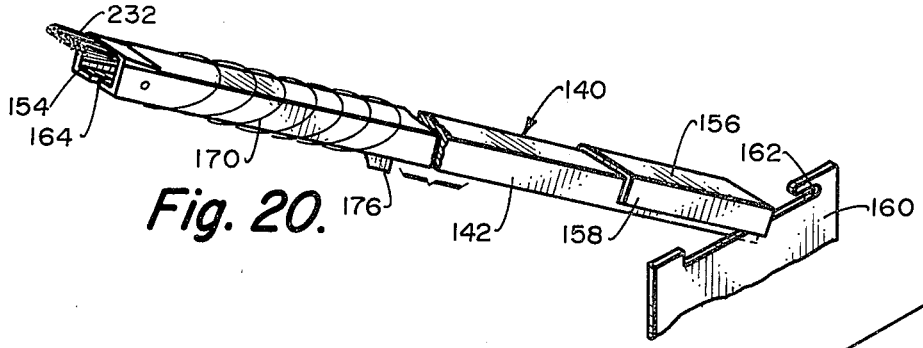
FIG. 20 is an isometric view of a first embodiment of button dispensing mechanism of this invention showing this mechanism about ready to be installed in position within the upholstery machine of this invention.
Figure 21:
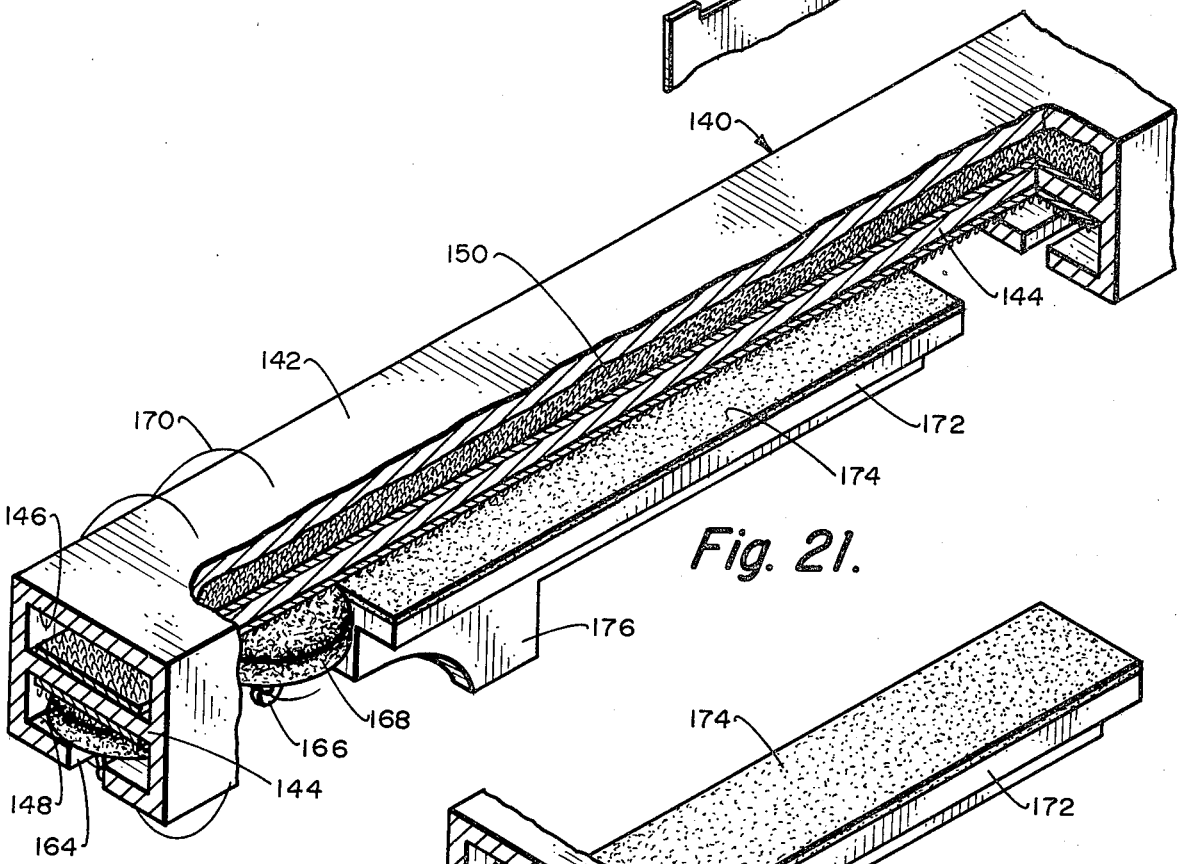
FIG. 21 is an isometric view, partially cut-away showing the internal mechanism of the first embodiment of button dispensing mechanism of this invention.
Figure 22:
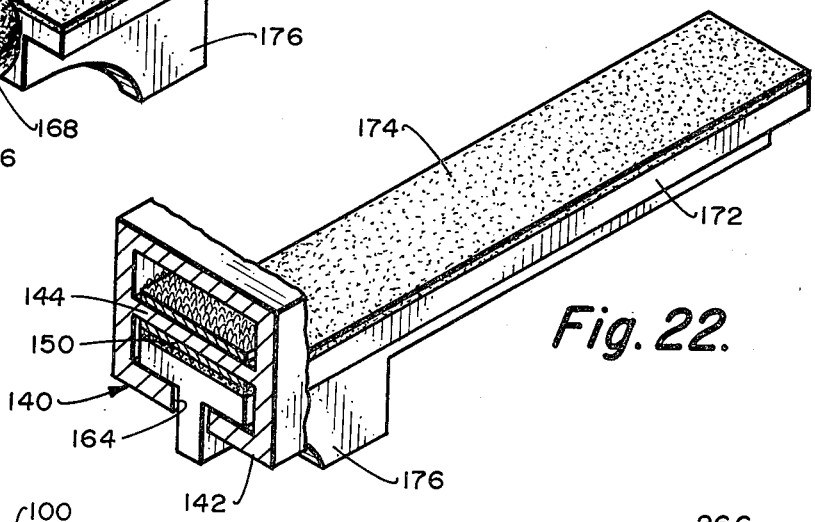
FIG. 22 is a view similar to FIG. 21 but with a further portion of structure cut-away so as to clearly show the cam arrangement attached to the endless belt to effect movement of the buttons to the dispensing area.
Figure 23:
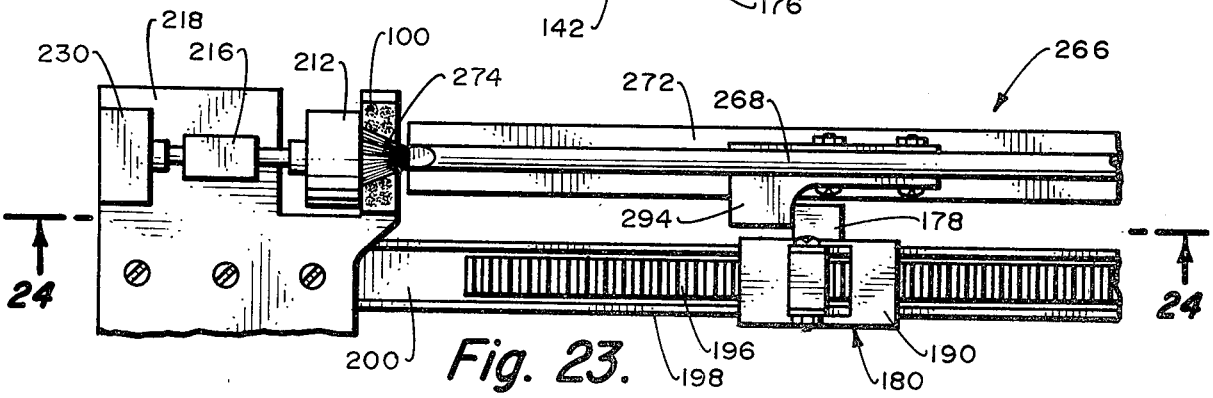
FIG. 23 is a top plan view of second embodiment of button dispensing mechanism of this invention.
Figure 24:
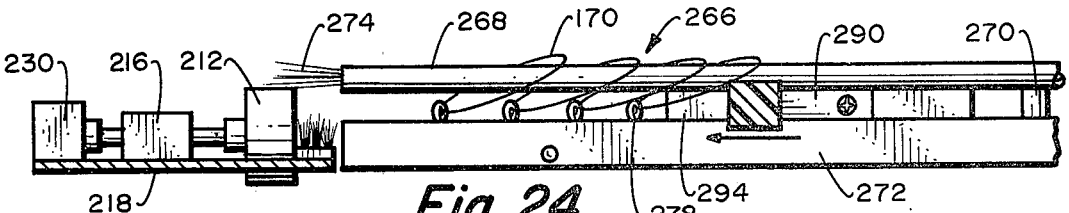
FIG. 24 is a front view, partially in cross-section taken along line 24—24 of FIG. 23.
Figure 25:
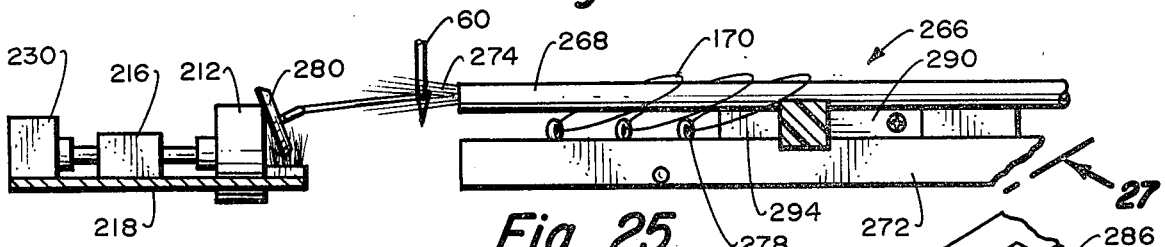
FIG. 25 is a view similar to FIG. 24, but showing a button dispensed and the loop string engaged with the needle.
Figure 26:
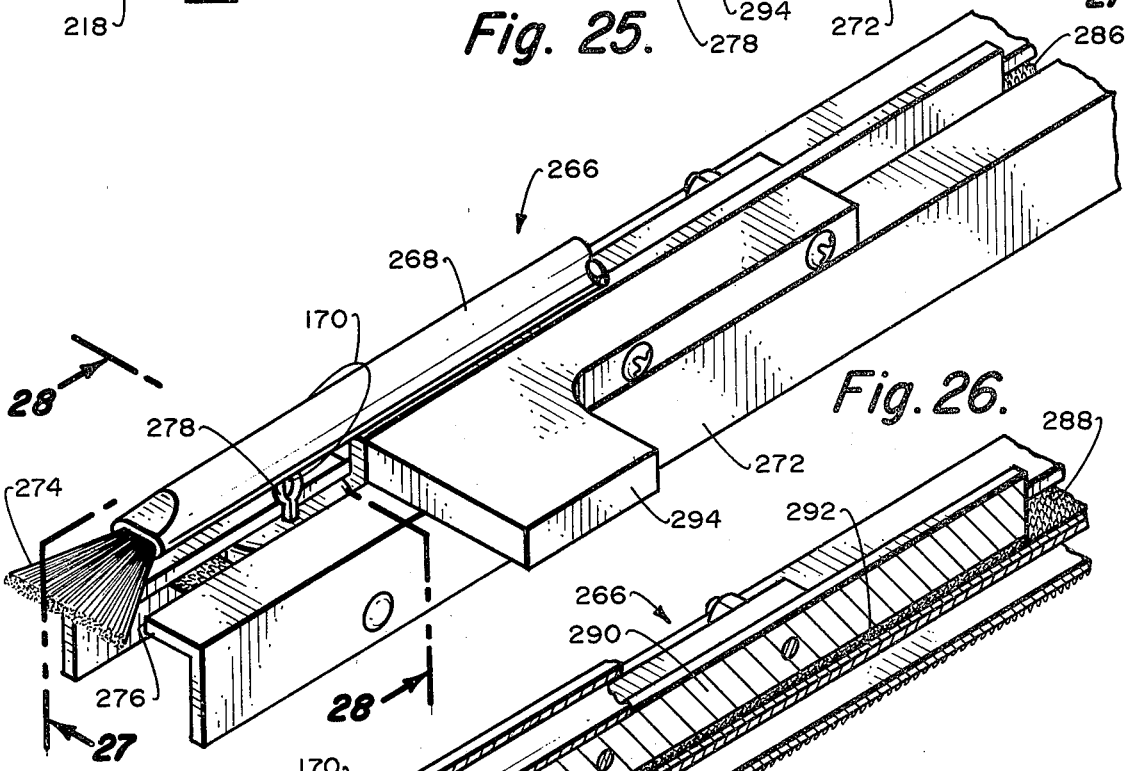
FIG. 26 is an isometric view of the cam portion of the second embodiment of button dispensing mechanism of this invention.
Figure 27:
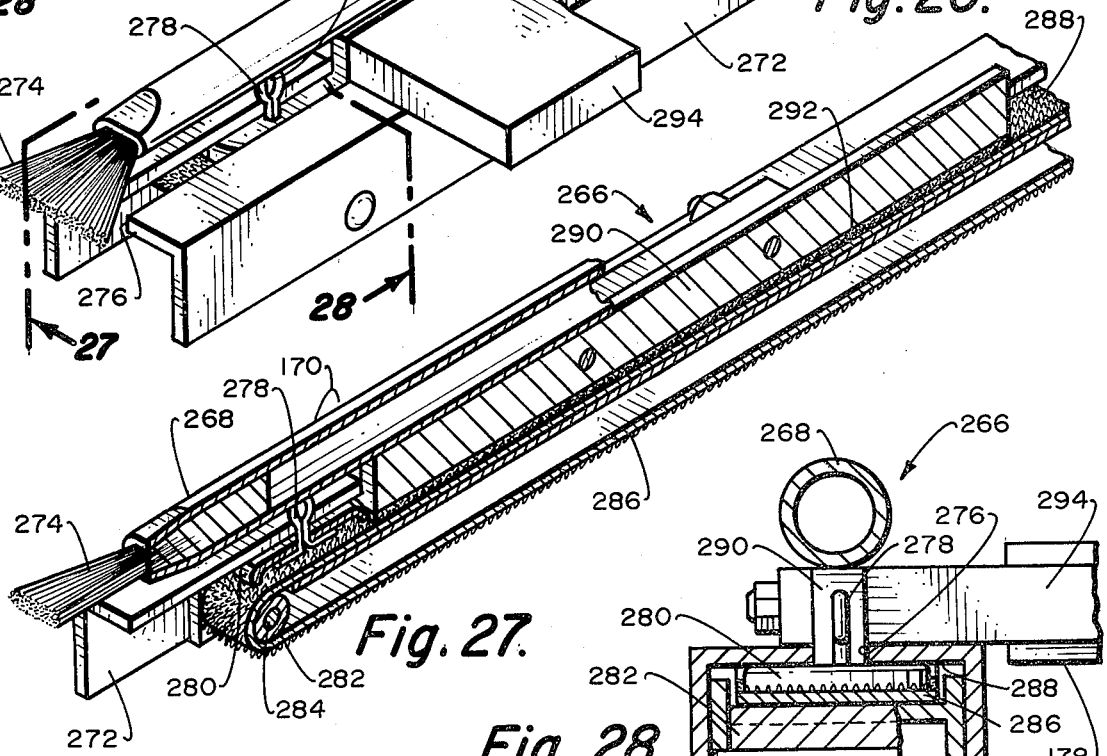
FIG. 27 is a cross-sectional view taken through line 27—27 of FIG. 26.
Figure 28:
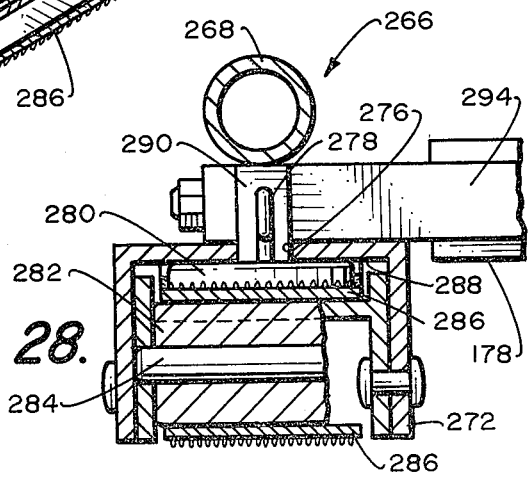
FIG. 28 is a cross-sectional view taken through line 28—28 of FIG. 26.

The innermost end of the elongated housing 142 is fixedly attached to an attaching plate 156 (FIG. 20). A portion of the attaching plate 156 extends laterally from the housing 142 and has a downwardly extending flange 158 extending therefrom. A plate 160 is fixedly mounted at a desired position within the table section 34 (adjacent the right side of the table section looking at FIG. 1). The plate 160 includes a slot 162. When the attaching plate 156 is caused to begin to engage with the slot 162 (as shown within FIG. 20), and then completely engage with the slot 162 as shown within FIG. 19, the button dispensing mechanism 140 is automatically installed in the correct position within the table section 34. In this position, the upper surface of the elongated housing 142 is located substantially in parallel to the operating surface 136.

Formed within the lower surface of the housing 142 and connecting with the lower compartment 148 is an elongated slot 164. The purpose of the slot 164 is so that the eyelets 166 of each first button 168 are positioned within the slot 264 in a row. Also, the buttons 168 are located in a row. The body of each of the first buttons 168 will be constructed of metal which will be covered with some type of material, such as a fabric. It is to be understood that there will be available slightly different button dispensing mechanisms 140 so as to handle different thicknesses of button bodies 168. In other words, a thicker button body 168 will require a thicker compartment 148, and logically, a thinner button body 168 will require a thinner compartment 148. It is important when the button bodies 168 are located within the compartment 148, that the bodies 168 will rest against the strip 150 of the frictionally grabbing material.

Figure 9:
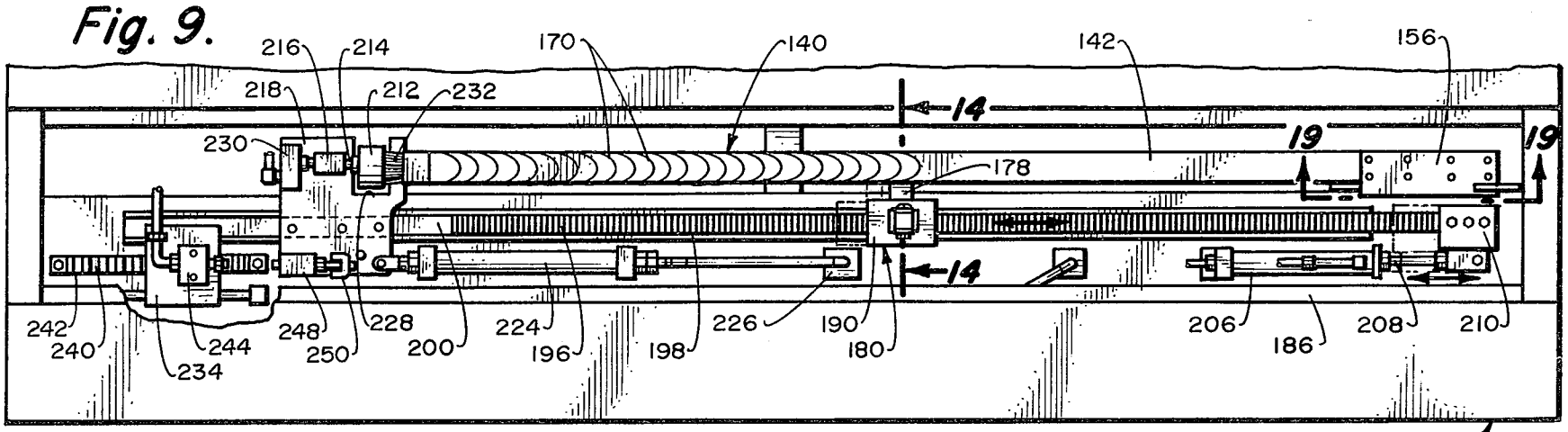
FIG. 9 is a top plan view of the interior of the operating table of the upholstery machine of this invention showing generally a button dispensing mechanism included within this machine.

Connected to each eyelet 166 is a loop 170 of string. The length of the loop 170 is selected for the particular installation. In other words, for a given thickness of cushion 74, the length of the loop 170 may be whatever is desired, such as two inches, three inches, or four inches. Each of the loops 170 are located about an elongated housing 142 assuming a spaced-apart relationship, as is shown within FIGS. 9 and 20.

Located within the compartment 148 is a member 172. This member 172 will initially be positioned adjacent the end of the housing 142 that is nearest the attaching plate 156. The member 172 has a planar inner surface upon which is attached a strip 174 of frictionally grabbing material. The strip 174 will normally take the form of a mass of tiny hooks which are to connect with the mass of tiny eyelets of the strip 150. The strip 174 is to be in continuous contact with the strip 150. The forward end of the member 172 is to be in contact with the first button body 168 of the row of buttons which have been stored within the compartment 148.

The member 172 has an outwardly extending cam 176. Cam 176 extends through slot 164. Cam 176 is to be in continuous contact with actuating members 178 of a jack 180.

When the housing 142 is installed within the table section 34, it is important that the loops 170 do not become entangled but remain in their spaced relationship. In order to insure that this relationship is maintained for the loops 170, there is provided a row of protruding flexible members 182, which is to be just in contact with the top of the housing 142 and therefore to brush against the loops 170. These flexible members 182 are mounted on the undersurface of the cover 184. This cover 184 is shown within FIG. 10. This cover 184 fits within a mating opening 186 formed within the surface 136. It is to be noted that in the area of the discharge opening 154 a very soft pliable raker member 188 is utilized which insures that the dispensed first button 168 will be properly dispensed and the loop 170 will not "hang up" and prevent proper dispensing of the first button 168.

The actuating member 178 is fixedly attached through conventional fastening means to the jack housing 190. Extending longitudinally through the jack housing 190 is an elongated opening 192. Rotatably mounted within the jack housing 190 and extending within the opening 192 is a ratchet wheel 194. The ratchet wheel 194 is movable longitudinally with respect to the housing 190 a limited distance as is shown between the dotted line and phantom line position in FIG. 16. The ratchet wheel 194 is engaged with the teeth 196 of a rack 198. The rack 198 is slidingly movable within a channel member 200. The channel member 200 is fixedly attached by means of a plurality of upstanding studs 202 to the fixed mounting structure within the table section 34.

Referring particularly to FIG. 16, if the rack 198 is moved to the left, the ratchet wheel 194 assumes the solid line position and is prevented from rotating by means of lock member 204 which is mounted within an appropriate cavity within the jack housing 190. Movement to the right of the rack 198 causes the ratchet wheel 194 to be moved out of engagement with the lock member 204 to the dotted line position shown within FIG. 16. Also, the ratchet wheel 194 will pivot. Therefore, movement of the rack 198 to the right results in no lineal movement of the jack housing 190 with respect to the table section 34. This lineal movement of jack housing 190 is translated through the actuating member 178 to the cam 176, which in turn moves endless belt strip 150. This results in movement of the entire row of first buttons 168, with the result that the first button 168 directly adjacent the discharge end 154 is discharged through the discharge end 154.

Movement of the rack 198 is accomplished by actuator 206 which is mounted within the table section 34. The piston rod 208 of the actuator 206 is attached to block 210 which in turn is secured to the outermost end of the rack 198. The actuator 206 will be actuated by an appropriate bleeder valve assembly which will be described further on in the specification.

The dispensed first button 168, when immediately dispensed, will be caught by magnet 212 (FIG. 4). The magnet 212 is mounted on a rod 214 which is slidably mounted within a guide block 216. The guide block 216 is fixedly mounted on a carriage plate 218. This carriage plate 218 has attached on its under surface a block 220. The block 220 is slidably mounted within a portion of the channel member 200. The carriage plate 218 is attached to one end of an actuator 224. The actuator 224 includes a piston rod 222 which is attached to a fixed block 226 which is fixedly mounted within the fixed structure of the table section 34.

The magnet 212 is mounted within an opening 228 formed within the carriage plate 218. The magnet 212, when contacted by the dispensed button 168, is moved from the forward end of the opening 228 to the rear portion of the opening 228 (approximately three sixteenths of an inch) as is shown within FIG. 4 of the drawings. This causes similar movement of the rod 214 which slides within the guide block 216 and actuates bleeder valve 230 which is mounted on carriage plate 218, which now instructs the actuator 206 to reverse thereby moving the rack 198 back to its at-rest position. Due to the pivoting of the ratchet wheel 194, the jack 180 remains in its established position and is not moved backward along with the rack 198.

Also at this particular time, the bleeder valve 108 is contacted by the cam surface 104 which activates actuator 224. This starts the carriage plate 218 to move to the left from the position shown in FIG. 4 to the position shown in FIG. 5. During this movement, there is a small spring (not shown) located within the bleeder valve assembly 230 which was overcome by the physical force of the dispensed button 168 pushing against the magnet 212. Once the carriage plate 218 proceeds to move, this force no longer exists and the spring within the bleeder valve assembly 230 will cause rod 214 to be returned to its right hand position shown within FIG. 5. This is desired since this now repositions the magnet 212 ready to receive the next dispensed button 168.

The carriage plate 218 will move an amount which is preset determined by the length of the loop 170. It is the purpose of the carriage plate 218 to move a distance sufficient so that the end of the loop 170 will disengage from the housing 142 and be guided over brush 232 until the loop engages with slot 64 of the needle 60. The brush 232 is fixedly attached on the end of the elongated housing 142 and the needle 60 extends within the bristles of the brush 232. The purpose of the brush 232 is to insure that the loop 170 will be conducted so as to engage with the slot 64.

The amount of movement of the carriage plate 218 is to be preset by means of a stop block 234. This block 234 has a pair of engaging foot members 236 and 238 which are to engage with a pair of notches 240 of a rack 242. Rack 242 is fixedly mounted onto a portion of the table section 34. Varying the position of stop block 234 within the notches 240 will thereby vary the extent of movement of the carriage plate 218.

Mounted on the stop block 234 is a valve assembly 244. The position of the stop block 234 is located within the appropriate pair of notches 240 so that when the carriage plate 218 reaches the position (shown within FIG. 12) of actuating the valve 244, that the end of the loop 170 is located within the slot 64 of the needle 60. At this particular instant, the valve 244 is actuated which directs actuator 42 to move the needle 60 upward. However, the carriage plate 218 continues to move a short distance until the carriage plate 218 directly contacts the stop block 234. This additional movement causes the rod 246, which has caused actuation of the bleeder valve 244, to move in respect to guide block 248. Guide block 248 is fixedly mounted on the carriage plate 218.

The outer end of the rod 246 is attached to a small magnet 250. This magnet 250 is unseated from the block 248 which results in deactivation of the valve 244. The reason for this is that the needle 60 is moving upwardly to contact bleeder valve assembly 116, and it is necessary that bleeder valve 244 now be inactive or else the new signal produced by bleeder valve 118 will not result in reverse movement of the needle 60 from the intermediate upper position to the lower upper position. Upon the carriage plate 218 being returned to its normal position adjacent the discharge opening 154, the magnet 250 will re-engage with the guide block 248.

The elongated housing 142 of the button dispensing mechanism 140 is basically cantilevered with respect to the plate 160. In order to insure precise location of the discharge end 154, the housing 142 will rest on a guide 252. This guide 252 is mounted directly onto a portion of the table section 34.

The operation of the upholstery machine of this invention is as follows: There will have to be some initial adjustments made prior to operating the upholstery machine 30 of this invention. The operator is to move lever 254 to the off position, which means that the upholstery machine 30 is not being supplied with pressurized air. When it is desired to operate the upholstery machine 30, the operator is to move lever 254 to the on position. Next, it is important that then the needle has grasped the loop 170 and is moved to the up position, that it moves to the up position no distance greater than the length of the loop so that the button 168 and its connected loop 170 will be in the position shown in FIG. 6 of the drawings. This means that the operator must adjust the position of bleeder valve assembly 116. Also, bleeder valve assembly 128 moves in conjunction with bleeder valve assembly 116. This is accomplished by means of knob 256 which is to be adjusted to correspond directly to the series of numbers which are inscribed on the housing 40 which is to correspond to the length of the loop 170. Once this has been set, the knob 256 is tightened and thereby fixing the position of the bleeder valve assembly 116. Also, as previously mentioned, the stop pins 76 and 86 are set for the movement of the compression rings 68 and 70. Also, as previously mentioned, the operator then sets the position of the stop block 234 also according to the length of the loop 170 that is being used.

The button dispensing mechanism 140 has been preloaded with the buttons 168 and is installed in its correct position within the upholstery machine of this invention. Cover 184 is located in position within the operating surface 136 and now the machine 30 is ready to be operated. The operator turns lever 254 to the position which supplies pressurized air to all the appropriate valves and actuators within the machine 30. The operator then locates the cushion 74 in the desired position selecting a given location for installation of the button assembly. The operator then presses plate 258. Plate 258 simultaneously activates three separate bleeder valves located behind the plate 258. The first bleeder valve activates the actuator for the guide rings 68 and 72 and causes such to move to the position shown within FIG. 5 of the drawings. The second bleeder valve causes the rack 198 to move, which through the jack 180 and the cam 176 causes the dispensing of a single button 168 to substantially the position shown within FIG. 4 of the drawings. As the button 168 pushes against the magnet 212, the valve 230 is actuated which prevents further movement of the rack 198 and actually causes the rack to return to its initial position ready to dispense another button 168. As previously mentioned, when the rack 198 returns, the jack 180 remains in its set position.

The third bleeder valve, which is activated by the plate 258, activates actuator 42 to cause the needle 60 to move down and penetrate the cushion to the position shown within FIG. 5 of the drawings. With the needle 60 in this completely down position, the lower cam surface 104 has contacted the valves 108 and 110. Valve 108 then causes carriage plate 218 to be moved to the position shown within FIG. 5. In this position, string loop has been stretched and now engages with the slot 64 of the needle 60. At the same time, the bleeder valve 110 has activated actuator 114 to cause bleeder valve 116 to move to the extended position as shown in the phantom line position of FIG. 18.

Figure 12:
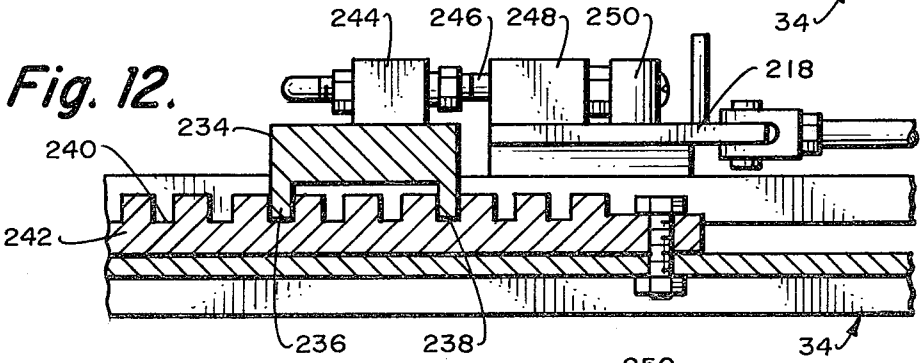
FIG. 12 is a cross-sectional view taken along line 12—12 of FIG. 11.
Figure 13:
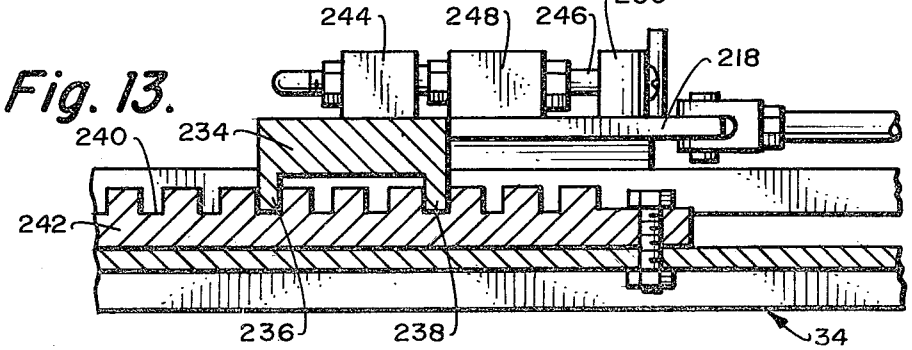
FIG. 13 is a view similar to FIG. 12 but showing this mechanism fully retracted.
Figure 11:
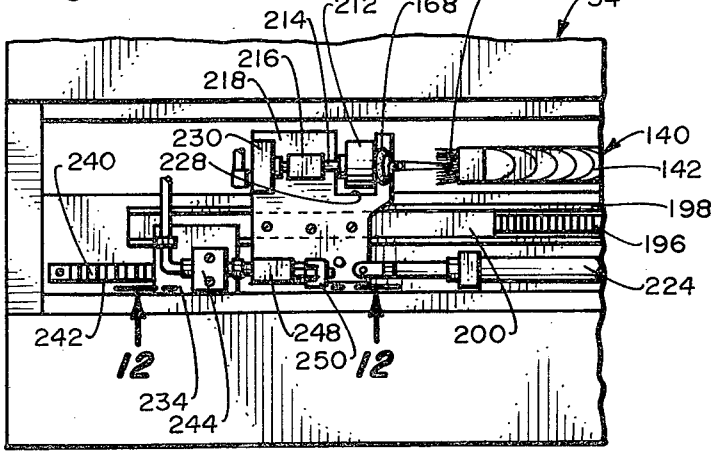
FIG. 11 is a view similar to FIG. 9 taken along line 11—11 of FIG. 5.
Figure 14:
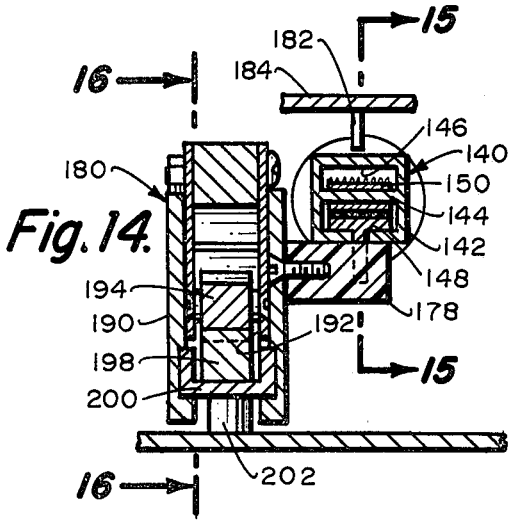
FIG. 14 is a cross-sectional view taken along line 14—14 of FIG. 9 showing the jack assembly which is used in conjunction with the dispensing of the buttons within the button dispensing mechanism.
Figure 15:
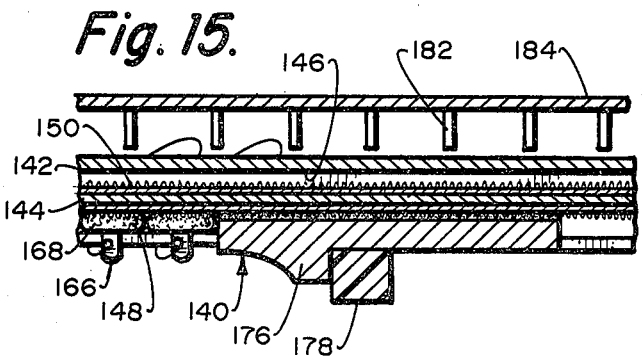
FIG. 15 is a cross-sectional view taken along line 15—15 of FIG. 14.

The carriage plate 218, when in the almost completely extended position, engages with valve assembly 244 on the stop blcok 234 (FIG. 12). This signals through actuator 42 to move the needle 60 toward the upper position. This movement continues until the cam surface 106 contacts the bleeder valve assembly 116. This is what has been previously determined as the upper intermediate position. However, the carriage plate 218 continues to move until it is in the completely extended position (FIG. 13). Magnet 250 is unseated, which moves rod 246 deactivating valve 244. Now the activator 42 is capable of receiving the new signal of valve 118 upon the needle reaching the upper intermediate position.

The bleeder valve 120 then signals actuator 224 to move the carriage plate 218 back to its initial position. Bleeder valve 118 now instructs through actuator 42 to move the needle in a downward direction. The valve 122 actuates actuator 126 to move valve assembly 128 to the extended position.

Figure 6:
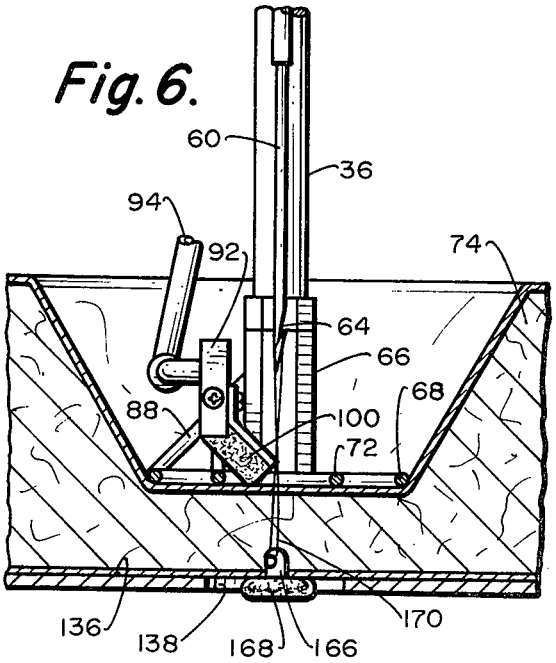
FIG. 6 is a view similar to FIG. 5 but showing the needle in an upper position and the loop of string of the lower button being drawn taut.
Figure 7:
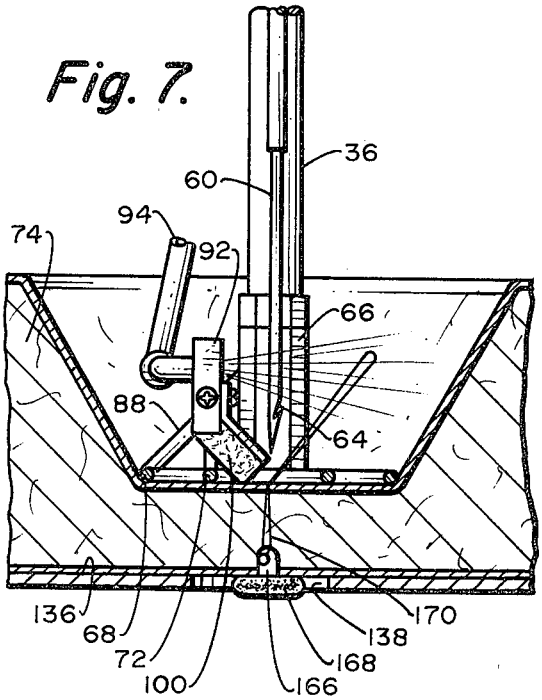
FIG. 7 is a view similar to FIG. 6 but showing the disengagement procedure for disengaging the loop of string from the needle.

As the needle 60 moves from the upper intermediate position shown in FIG. 6 to the lower upper position shown within FIG. 7, the string loop 170 is to become disengaged from the slot 64. At the time valve assembly 128 extends, the cam block 98 comes into contact with the valve 96. This results in a small blast of air being supplied to nozzle 92 which blows against the now free end of the string loop 170 so as to insure that it disengages from the slot 64. The keeper 100 insures that the loop 170 will not tend to re-engage with the slot 64 after the blast of air has stopped.

At this time, the needle 60 is in the lower upper position, which results in the cam surface 104 contacting the bleeder valve assembly 128. The bleeder valve 134 actuates actuator 22 to retract bleeder valve aassembly 116. Bleeder valve 132 activates actuator 42 to direct the needle 60 to its upper position which is shown within FIG. 3 of the drawings. The bleeder valve 130 activates actuator 126 to move the bleeder valve assembly 128 back to the retracted position.

Now the needle 60 is in the uppermost position and completely out of the way so as to not hinder manual connection of the eyelet 260 of a second (or upper) button 262 to the string loop 170. This connection to the string loop 170 is accomplished with the compression rings depressing into the cushion 74. Once the button 262 has been correctly installed, the operator manually activates switch mounted within switch housing 264 which instructs the actuator connected to the compression rings 68 and 72 to move such to the upper position shown within FIG. 3. The operator is then free to move the cushion to the next dot 84 or location where it is desired to install a button assembly.

Referring particularly to FIGS. 23–28 of the drawings, there is shown a second embodiment of button dispensing mechanism 266. The mechanism 266 is to function in precisely the same manner as the button dispensing mechanism 140. However, the dispensing mechanism 266 has one primary advantage over the mechanism 140 in that the mechanism 266 can be utilized with a substantially smaller string loop 170. Within the mechanism 140, the string loop is to be conducted entirely around the elongated housing 142. Within the mechanism 266, the string loop is conducted only around elongated rod 268. The rod 268 is secured in a cantilevered fashion upon the elongated housing 272 by means of an attaching block 270. The elongated rod 268 has a brush 274 fixedly connected to its outer end. The brush 274 is to connect with the needle 60 and is to function in precisely the same manner as the previously described brush 232.

Elongated housing 272 includes a slot 276 formed in its upper surface thereof through which is to be conducted eyelets 278 of the first button 280. Located between the side walls of the housing 272 are a pair of spaced-apart rollers 282 (only one being shown). Each roller 282 is rotatable in respect to the housing 272 by means of a pivot pin 284. Located about the pair of rollers 282 is an endless belt 286 of frictionally grabbing material which is basically identical to frictionally grabbing material 150.

Located between the upper surface of the belt 286 and the portion of the housing 272 adjacent the slot 276 is an elongated compartment 288. Within the compartment 288 there is to be located a row of first buttons 280.

Also located within the compartment 288 just rearward of the rearwardmost button 280 is a cam block 290. The lower surface of the cam block 290 has attached thereto a strip 292 of frictionally grabbing material, which is basically identical to strip 174 previously described. It is to be noted that the rod 268 will just rest against the upper surface of the cam block 90, but the cam block 290 will readily slide relative to the rod 268.

The cam block 290 has a laterally extending section 294. This laterally extending section 294 is to be contacted by the actuating member 178. Movement of the actuating member 178 through the jack 180 by means of the rack 198 will result in movement of the cam block 290 and the endless belt 286 which in turn will singlely dispense the first buttons 280 as is depicted within FIG. 25.

It is to be considered to be within the scope of this invention that different types of button dispensing mechanisms could be employed without departing from the scope of this invention. For illustrative purposes only, there have been shown only two different types, those being button dispensing mechanism 140 and button dispensing mechanism 266.

What is claimed is:

1. In combination with an upholstery machine for the tufting of a button assembly within a cushion, said upholstery machine including a movable needle, each said button assembly including a first button and a second button, said first button having an attaching eyelet protruding therefrom through which is attached a string loop which extends therefrom, a button feeding mechanism comprising:

an elongated housing;

a strip of frictionally grabbing material movably mounted on said elongated housing, an elongated guide channel formed between said housing and said strip, said elongated guide channel being adapted to snugly retain a row of said first buttons, said guide channel terminating in a discharge end;

cam means attached to said strip, said cam means adapted to be contacted by an actuating means for moving said strip, said cam means for causing movement of said row of said first buttons resulting in a discharge of a said first button from said discharging end of said guide channel; and loop guide means attached to said housing, each said string loop of said first button being located about said loop guide means, whereby after discharge of a said first button from said discharge end the said string loop for that said first button is guided by said loop guide means to engage with said movable needle.

2. The combination as defined in claim 1 wherein:

said strip of frictionally grabbing material comprising an endless belt.

3. The combination as defined in claim 1 wherein:

said housing including an elongated guide slot, said attaching eyelet of said first button being located within said guide slot.

4. The combination as defined in claim 3 wherein:

said elongated housing having attached thereto a brush, said brush being located directly adjacent said discharge end, said brush to connect with said movable needle, whereby said brush to cause said string loop of the being dispensed said first button to be guided to engage with said movable needle.

5. The combination as defined in claim 1 wherein:

said loop guide means comprising an elongated rod, said elongated rod being secured to said housing and spaced slightly therefrom.

6. The combination as defined in claim 5 wherein:

said elongated rod having a brush attached thereto, said brush being adapted to connect to said movable needle, said brush being located directly adjacent said discharge end of said housing.

7. An upholstery machine for the tufting of buttons within a cushion comprising:

first means for penetrating the cushion;

a first button assembly comprising a button which is attached to a string loop;

second means for singlely dispensing said first button assembly so that said string loop of the dispensed said first button assembly engages with said first means after said first means has penetrated the cushion, said second means containing a plurality of said first button assemblies;

third means for moving said first means out of penetration with said cushion which causes said string loop of the dispensed said first button assembly to extend through said cushion and protrude exteriorly therefrom; and fourth means for disengaging said string loop of said dispensed button assembly from said first means, whereby a second button assembly is then to be manually connected to said string loop.

8. The upholstery machine as defined in claim 7 wherein:

said second means including a dispensing housing, said dispensing housing having a discharge end from which the said dispensed button is to be discharged, a magnet being located directly adjacent said discharge end but spaced therefrom, the said dispensed button upon being discharged from said discharge end is moved into contact with said magnet, said magnet being movable with respect to said first means to cause said string loop of said dispensed button to be stretched taut and come into engagement with said first means.

9. The upholstery machine as defined in claim 8 wherein:

loop raker means located directly adjacent said second means, said loop raker means to engage with said string loops of said plurality of said first button assemblies, whereby said raker means preventing entangling of said string loops of said plurality of said first button assemblies.

10. The upholstery machine as defined in claim 7 wherein:

said second means including a dispensing housing, a strip of frictionally grabbing material movably mounted within said dispensing housing, said plurality of said first button assemblies being engaged with said strip, cam means attached to said strip, said cam means to be contacted by actuating means for moving said strip, said actuating means including a ratacheting device, said ratcheting device being in engagement with a rack, said rack being movable in a forward direction and a reverse direction, when said rack is moved in said forward direction the said actuating means is also moved which causes movement of said cam, movement of said rack in the rearward direction results in nonmovement of said actuating means.

11. The upholstery machine as defined in claim 7 wherein:

said upholstery machine includes positioning means to accurately locate a point on the cushion where it is desired for first means to penetrate the cushion.

12. The upholstery machine as defined in claim 7 wherein:

said upholstery machine includes cushion compressing means, said cushion compressing means to physically compress the cushion about the area of penetration by said first means in order to facilitate access to said string loop upon such protruding exteriorly of the cushion.

13. The upholstery machine as defined in claim 11 wherein:

said upholstery machine includes cushion compressing means, said cushion compressing means to physically compress the cushion about the area of penetration by said first means in order to facilitate access to said string loop upon such protruding exteriorly of the cushion.

14. The upholstery machine as defined in claim 13 wherein:

said cushion compressing means comprising a ring which is movable from an upper position to a lower cushion compressing position, said ring also functioning as said positioning means.

15. The upholstery machine as defined in claim 14 wherein:

said first means passing through the substantial center of said ring.

16. An upholstery machine for the tufting of buttons within a cushion comprising:

a housing, said housing including a table section and an upright stanchion section, said upright stanchion section spaced above said table section;

a needle mounted on said upright stanchion section, said needle being movable relative to said table section between a lower position and an upper position, said needle having engagement means, said needle being adapted to have penetrated a cushion when in said lower position;

a button dispensing mechanism mounted within said table section, said button dispensing mechanism being adapted to retain a plurality of first button assemblies, each said first button assembly having a button body to which is connected a loop of string, said button dispensing mechanism adapted to singlely dispense a said first button assembly causing its said loop of string to engage with said engagement means of said needle when said needle is in said lower position;

movement means for moving said needle to said upper position causing said loop of string to be conducted through said cushion and become taut; and disengagement means for causing said loop of string to disengage said needle after movement to said upper position.

17. The upholstery machine as defined in claim 16 wherein:

said engagement means comprising a slot formed within said needle.

18. The upholstery machine as defined in claim 16 wherein:

said needle being movable within a predetermined length of stroke, said length of stroke being adjustable to accommodate different thickness of cushion.

19. The upholstery machine as defined in claim 16 wherein:

said plurality of said first buttons being supported within a row within said button dispensing mechanism.

20. The upholstery machine as defined in claim 19 wherein:

said button dispensing mechanism including a dispensing housing, a strip of frictionally grabbing material being movably mounted upon said dispensing housing, an elongated guide channel formed between said dispensing housing and said strip, said row of first button assemblies snugly retained within said elongated guide channel, said guide channel terminating in a discharge end, each said first button assembly adapted to be dispensed from said discharge end.

21. The upholstery machine as defined in claim 20 wherein:

said strip of frictionally grabbing material comprises an endless belt.

22. The upholstery machine as defined in claim 21 wherein:

cam means being attached to said strip, said cam means to be contacted by an actuating means for moving said strip.

23. The upholstery machine as defined in claim 22 wherein:

said actuating means comprising a jack, said jack including a ratchet mechanism, said jack being mounted on a rack, said rack having a series of teeth, said ratcheting device to engage with said teeth, movement of said rack in the forward direction causes movement of said jack one increment which in turn results similar movement of said strip, movement of said rack in the reverse direction results in pivoting of said ratcheting device and non-movement of said jack.

24. The upholstery machine as defined in claim 22 wherein:

the said loop of string for each of said first button assemblies being conducted about the exterior surface of said button dispensing housing thereby locating said loops in a substantially evenly spaced series arrangement.

25. The upholstery machine as defined in claim 24 including:

said table section including a raking apparatus, said raking apparatus to be in contact with said loops to thereby prevent entanglement of said loops during the sequential dispensing of said first button assemblies.

26. The upholstery machine as defined in claim 24 wherein;

said dispensing housing terminating in a brush, said brush being in contact with said needle when said needle is in said lower position, said brush functioning to guide the said loop of string of said first button assembly that is being dispensed into engagement with said engagement means of said needle.

27. The upholstery machine as defined in claim 24 wherein:

each of said first button assembly having an attaching eyelet, said loop of string being connected with said attaching eyelet, said dispensing housing having an elongated guide slot, each said attaching eyelet for each said first button assembly being positioned within said elongated guide slot.

28. The upholstery machine as defined in claim 24 wherein:

said dispensing housing including an elongated rod, said loops being located about said elongated rod, a brush attached to an end of said elongated rod, said brush to be in contact with said needle when said needle is in said lower position, said brush to guide the said loop of the dispensed button assembly into connection with said engagement means of said needle.

29. The upholstery machine as defined in claim 16 wherein said disengagement means comprising:

said upper position of said needle comprising a lower upper position, an intermediate upper position and an uppermost position, with said needle in said intermediate upper position the said loop being held taut and in contact with said engagement means, movement of said needle to said lower upper position results in said loop becoming slack permitting disengagement from said engagement means, after disengagement of said needle from said loop the said needle is then to be moved to said uppermost position.

30. The upholstery machine as defined in claim 29 including:

airstream dispensing means mounted on said housing directly adjacent said needle, said airstream dispensing means to release a blast of air onto said loop when said needle has moved from said intermediate upper position to said lower upper position to further insure disengagement of said loop from said engagement means.

31. The upholstery machine as defined in claim 16 wherein:

each said first button assembly when dispensed from said button dispensing mechanism becomes held by a magnet assembly, which is located in an extended position, said magnet assembly then being movable to a retracted position which in turn causes said loop of the dispensed first button to move into connection with said engagement means of said needle.

32. The upholstery machine as defined in claim 31 wherein:

the length of movement of said magnet assembly from its extended position to its said retracted position being adjustable.

33. The upholstery machine as defined in claim 16 including:

cushion compressing means mounted on said housing, said cushion compressing means to move into contact with said cushion and compress such a predetermined amount prior to movement of said needle to said lower position.

34. The upholstery machine as defined in claim 23 wherein:

the amount of compression of the cushion by said compression means being adjustable.

35. The upholstery machine as defined in claim 33 wherein:

said cushion compressing means comprising a compression ring, said needle being conducted substantially through the center point of said compression ring, thereby the center point of said compression ring functions as a guide for the locating of the point of penetration of the cushion by said needle.

36. The upholstery machine as defined in claim 16 wherein said movement means includes:

an actuator for moving said needle, a valve for actuating said actuator, rod means movable in a first direction to cointact said valve causing actuation of said actuator, said rod means being connected to a magnet, further movement of said rod means in said first direction causes unseating of said magnet and disengaging of said valve.

* * * * *